United States Patent [19]

Wix

[11] Patent Number: 4,620,329

[45] Date of Patent: Nov. 4, 1986

[54] VENTILATED TOILET SEAT

[76] Inventor: John Wix, 16064 County Rd. 8, Meeker, Colo. 81641

[21] Appl. No.: 745,498

[22] Filed: Jun. 17, 1985

[51] Int. Cl.[4] ..... A47K 13/00; E03D 9/04

[52] U.S. Cl. ..... 4/217; 4/213

[58] Field of Search ..... 4/217, 213, 211

[56] References Cited

U.S. PATENT DOCUMENTS

| | | | |
|---|---|---|---|
| 1,997,695 | 4/1935 | Nielsen et al. | 4/213 |
| 2,079,733 | 5/1937 | Cummings | 4/213 |
| 2,146,982 | 2/1939 | Perreault | 4/217 |
| 2,181,510 | 11/1939 | Dahlke | 4/213 |
| 2,309,774 | 2/1943 | Kistler | 4/213 |
| 2,728,088 | 12/1955 | Gudish | 4/217 |
| 3,887,949 | 6/1975 | Osmond | 4/213 X |
| 4,071,915 | 2/1978 | Kurataro | 4/217 |
| 4,125,906 | 11/1978 | Weiland | 4/217 |
| 4,251,888 | 2/1981 | Turner | 4/217 X |
| 4,365,361 | 12/1982 | Sanstrom | 4/213 |

*Primary Examiner*—Henry K. Artis

*Attorney, Agent, or Firm*—Norman B. Rainer

[57] ABSTRACT

Air is removed from the vicinity of a toilet bowl of conventional design by means of a ventilation system comprising a toilet seat having an internal channel that conveys air through the hinge mechanism of the seat to an exhaust fan. The hinge mechanism is comprised of paired units, each utilizing interengaged threaded hollow tubes and right angle fittings to establish passageway between the channel of the seat and downstream air-conveying components.

4 Claims, 4 Drawing Figures

VENTILATED TOILET SEAT

BACKGROUND OF THE INVENTION

This invention relates to apparatus for removing air from the vicinity of a toilet bowl.

Diverse types of devices have already been proposed for ventilating toilet bowls, but these generally necessitate expensive forms of fittings or involve considerable installation work, and usually interfere with accessibility for cleaning maintenance. For example, U.S. Pat. No. 3,501,784 discloses a ventilated toilet seat having an exhaust fan incorporated therein and venting through a tube emanating from the rear of the seat. U.S. Pat. No. 3,659,296 discloses the use of a fan and deodorizing element positioned within a cover member adapted to fit over the toilet bowl cavity. U.S. Pat. No. 988,273 discloses the use of a ventilator pipe, about which a hollow toilet seat of specialized design is pivotably disposed.

Toilet bowls in general use are of monolithic porcelain construction, having a flat upper rim upon which the seat rests, and paired vertically disposed channels adapted to accommodate posts which pivotably attach the rear of the seat to the bowl. Any modifications of the bowl for the purpose of accepting a specialized seat would be difficult to achieve.

It is accordingly an object of the present invention to provide a toilet seat and auxiliary means for removing air from the vicinity of a toilet bowl of generally standard design.

It is another object of this invention to provide a toilet seat as in the foregoing object capable of easy installation onto an existing toilet bowl of generally standard design without modification thereof.

It is another object of this invention to provide a toilet seat of the aforesaid nature of rugged and durable construction which may be economically manufactured.

These objects and other objects and advantages of the invention will be apparent from the following description.

SUMMARY OF THE INVENTION

The above and other beneficial objects and advantages are accomplished in accordance with the present invention by a toilet ventilation system adapted for use with a toilet bowl of conventional design comprising:

(a) a toilet seat of conventional outer contour having a forward extremity, rear extremity, flat bottom surface and rounded upper surface, and characterized in having a plane of symmetry that vertically bisects said forward and rear extremities, the interior of said seat being provided with a channel that substantially circumscribes the seat, said channel communicating with said bottom surface by means of a number of downwardly directed apertures, and communicating with said rear extremity by paired parallel vent passageways, (b) paired first externally threaded circular cylindrical tubes which engage said vent passageways, each extending to a rear terminus behind the rear extremity of the seat, (c) paired first right angle pipe fittings having female threading which engages the rear terminus of each of said first cylindrical tubes, (d) paired second right angle pipe fittings which threadably engage said first right angle fittings in a manner to be outwardly directed with respect to said plane of symmetry, and provided with internal threading, (e) paired second externally threaded circular cylindrical tubes, each having an upper extremity that engages the internal threading of said second right angle pipe fittings, and a downwardly disposed lower extremity, said second tubes being adapted to pass through the vertically disposed channels within said bowl, (f) conduit means communicating with the lower extremities of said second cylindrical tubes and extending to a downstream extremity at a location remote from said bowl, (g) electrically activated air-moving means associated with the downstream extremity of said conduit means, (h) pressure-responsive switch means interactive between the rim of the bowl and the bottom surface of the seat in a manner to energize said air-moving means when the seat is in use, and (i) paired eye bolts each pivotably engaging a horizontally disposed portion of said right angle pipe fittings and having a threaded stem adapted to engage the rear extremity of a lid to permit pivotal movement of said lid in a vertical path.

In preferred embodiments of the apparatus of the present invention, the conduit means are comprised of separate tubes or hoses of a flexible nature which engage the lower extremities of the second cylindrical tubes, and then merge into a single conduit line. The seat and lid may be fabricated of wood, plastic or bonded composite materials. The cylindrical tubes and right angle pipe fittings are preferably fabricated of metal to provide strength and durability.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
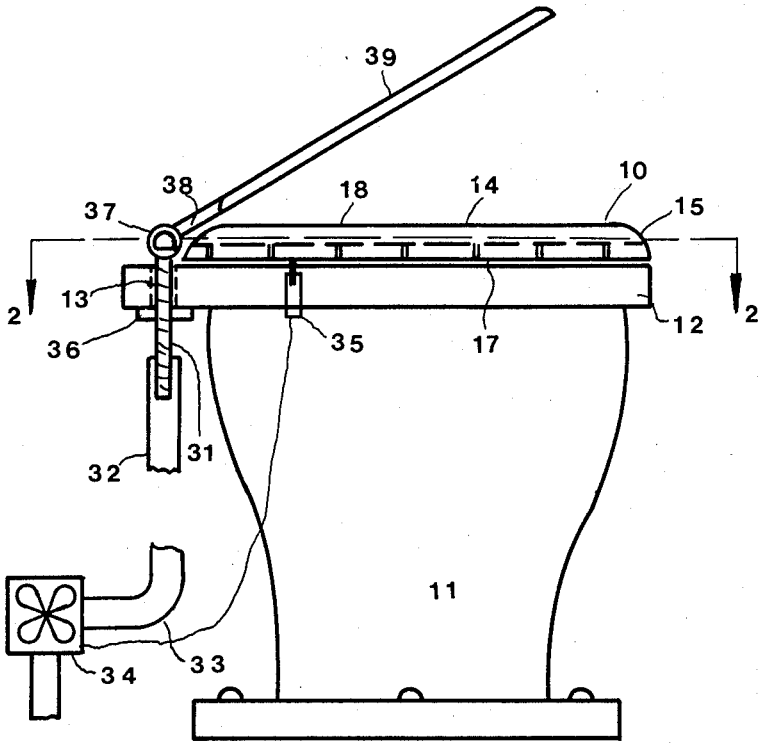
FIG. 1 is a side view of an embodiment of the toilet ventilation system of the present invention shown with the lid in a raised position.
Figure 4:
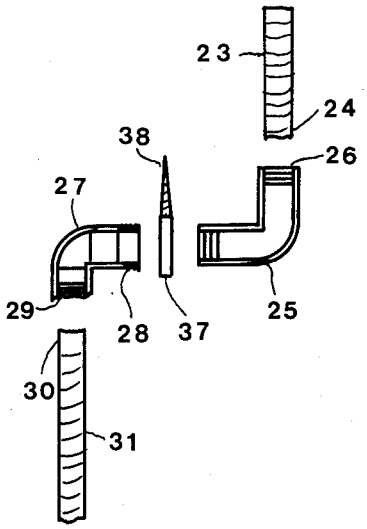
FIG. 4 is an exploded enlarged fragmentary view of FIG. 3 showing the tubes and fittings that engage the seat.

For convenience in description, the terms "front" and "rear", or words of similar import, will have reference to the right and left extremities, respectively, of the toilet ventilation system as shown in FIG. 1.

DESCRIPTION OF THE PREFERRED EMBODIMENT

Figure 2:
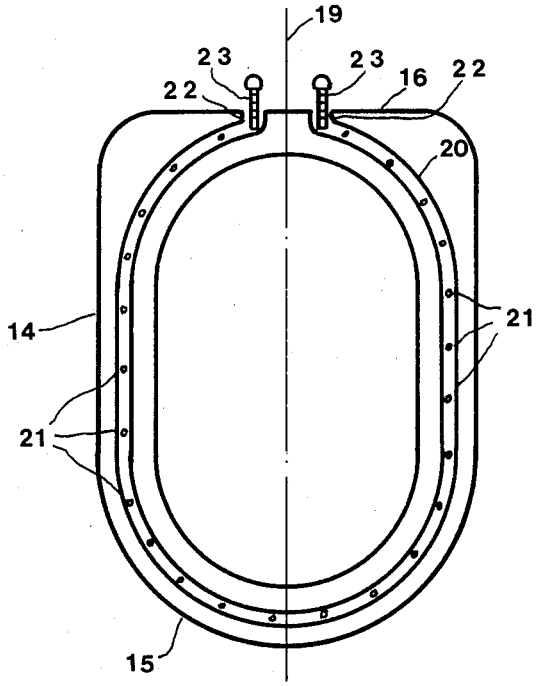
FIG. 2 is a sectional view taken along the line 2—2 of FIG. 1.
Figure 3:
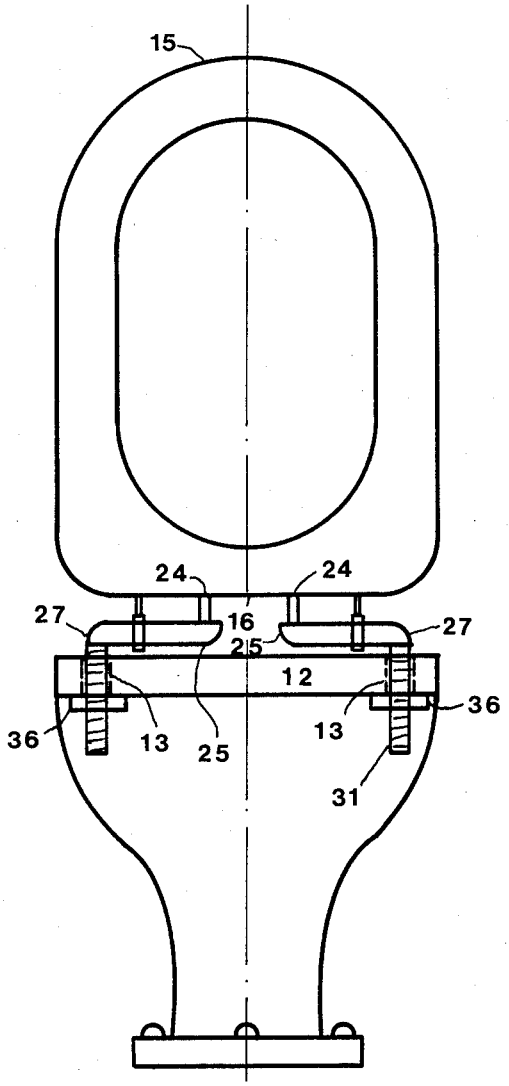
FIG. 3 is a rear view of the embodiment of FIG. 1 shown with both the lid and seat in raised position.

Referring to the drawing, an embodiment of a toilet ventilation system 10 of the present invention is shown in association with a toilet bowl 11 of conventional design having a flat upper rim 12 and paired vertical channels 13 adjacent the rear extremity of said rim. The ventilation system is comprised of toilet seat 14 of conventional outer contour having forward extremity 15, rear extremity 16, flat bottom 17, and rounded upper surface 18. The seat may be further characterized as having a plane of symmetry, represented by dashed line 19 in FIG. 2, said plane vertically bisecting the forward and rear extremities of the seat. The interior of the seat is provided with a channel 20 which substantially circumscribes the seat. Said channel communicates with bottom surface 17 by means of a number of downwardly directed apertures 21 uniformly spaced around the seat. Channel 20 communicates with the exterior of rear extremity 16 by paired parallel vent passageways 22.

Paired first externally threaded circular cylindrical tubes 23 engage vent passageways 22, each tube extending to a rear terminus 24 behind the rear extremity of the seat. Paired first right angle pipe fittings 25 having female threading 26 engage the rear terminus of each of said first tubes 23. Paired second right angle pipe fittings 27, provided with male thread 28, engage said first right angle fittings 25 in a manner to be outwardly directed with respect to said plane of symmetry. Said second right angle fittings are further provided with female or internal threading 29 which engages the upper extremity 30 of each of paired second externally threaded circular cylindrical tubes 31. Said second tubes pass through the vertical channels 13 in the toilet bowl. Holding nuts 36 threadably engage the second tubes and abut the underside of rim 12, thereby securing said tubes.

A flexible conduit hose 32 is attached to the lower extremity of each of said second tubes, and said hoses merge into a single hose 33 which leads away from the toilet seat and terminates in an electrically driven exhaust fan 34. The exhaust fan directs air to a remote location such as the exterior of the building or interwall or subfloor air spaces. When two or more toilet bowls are located in the same proximity, one exhaust fan can serve the several bowls.

A plunger-operated electrical on/off switch 35 is attached to the rim 12 of the bowl and is electrically connected to the exhaust fan. The switch is adapted to energize the exhaust fan when a significant weight is brought down upon the plunger. In other embodiments, the on/off switch may be attached to the bottom 17 of seat 14.

By virtue of the arrangement of the several components which hold the seat to the bowl, the seat is pivotably held whereby movement from upright to horizontal positions entails a one quarter turn of the first right angle fittings with respect to the stationary second right angle fittings. Because an exhaust path is established through the tubes and fittings, no modification of the toilet bowl is required.

An eye fitting 37, having a threaded tapered extremity 38 may be rotatively positioned upon a horizontally disposed portion of one of the right angle fittings. The threaded extremity 38 is adapted to engage the rear of a lid 39 of standard design, thereby permitting pivotal movement of said lid in a vertical path upon said seat.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A toilet ventilation system adapted for use with a toilet bowl of conventional design comprising:

(a) a toilet seat of conventional outer contour having a forward extremity, rear extremity, flat bottom surface and rounded upper surface, and characterized in having a plane of symmetry that vertically bisects said forward and rear extremities, the interior of said seat being provided with a channel that substantially circumscribes the seat, said channel communicating with said bottom surface by means of a number of downwardly directed apertures, and communicating with said rear extremity by paired parallel vent passageways, (b) paired first externally threaded circular cylindrical tubes which engage said vent passageways, each extending to a rear terminus behind the rear extremity of the seat, (c) paired first right angle pipe fittings having female threading which engages the rear terminus of each of said first cylindrical tubes, (d) paired second right angle pipe fittings which threadably engage said first right angle fittings in a manner to be outwardly directed with respect to said plane of symmetry, and provided with internal threading, (e) paired second externally threaded circular cylindrical tubes, each having an upper extremity that engages the internal threading of said second right angle pipe fittings, and a downwardly disposed lower extremity, said second tubes being adapted to pass through conventional vertically disposed channels within said bowl, (f) conduit means communicating with the lower extremities of said second cylindrical tubes and extending to a downstream extremity at a location remote from said bowl, (g) electrically activated air-moving means associated with the downstream extremity of said conduit means, (h) pressure-responsive switch means interactive between the conventional rim of the bowl and the bottom surface of the seat in a manner to energize said air-moving means when the seat is in use, and (i) paired eyebolts each pivotably engaging a horizontally disposed portion of said right angle pipe fittings and having a threaded stem adapted to engage the rear extremity of a lid to permit pivotal movement of said lid in a vertical path.

2. The ventilation system of claim 1 wherein said conduit means are comprised of separate tubes of a flexible nature which engage the lower extremities of the second cylindrical tubes, and then merge into a single conduit line.

3. The ventilation system of claim 2 wherein said air-moving means directs air from said condiut line to a location remote from said toilet bowl.

4. The ventilation system of claim 3 wherein said seat is pivotably held in a manner whereby movement from upright to horizontal positions entails a one quarter turn of the first right angle fittings with respect to the stationary second right angle fittings.

* * * * *